United States Patent [19]

Wismer

[11] Patent Number: 4,674,748

[45] Date of Patent: Jun. 23, 1987

[54] METHOD AND MEANS FOR RANDOMLY SELECTING A PLURALITY OF GROUPS OF NUMBERS

[76] Inventor: Brad A. Wismer, R.R. 4, Box 453, Winnebago Heights, Mason City, Iowa 50401

[21] Appl. No.: 841,567

[22] Filed: Mar. 20, 1986

[51] Int. Cl.[4] ..... A63F 5/04

[52] U.S. Cl. ..... 273/141 R; 273/142 HA

[58] Field of Search ..... 273/142 R, 142 HA, 141 R, 273/141 A

[56] References Cited

U.S. PATENT DOCUMENTS

| | | | |
|---|---|---|---|
| 3,647,217 | 3/1972 | Williams, Jr. et al. | 273/141 R X |
| 4,421,316 | 12/1983 | Brown | 273/141 R X |
| 4,437,666 | 3/1984 | Moylan | 273/141 R |
| 4,492,378 | 1/1985 | Williams | 273/142 HA |

FOREIGN PATENT DOCUMENTS

| | | | |
|---|---|---|---|
| 1056020 | 4/1959 | Fed. Rep. of Germany | 273/141 R |
| 2395047 | 2/1979 | France | 273/141 R |
| 2487210 | 1/1982 | France | 273/141 R |
| 2539639 | 7/1984 | France | 273/142 HA |
| 928858 | 6/1963 | United Kingdom | 273/141 R |

*Primary Examiner*—Paul E. Shapiro

*Attorney, Agent, or Firm*—Zarley, McKee, Thomte, Voorhees & Sease

[57] ABSTRACT

The present invention includes a base disc, an outer disc, a middle disc having three rings thereon, and an inner disc. All of these discs are rotatable with respect to one another about a common axis. A Velcro ring is provided on the inner disc and includes a plurality of Velcro triangles which may be positioned adjacent the numbers on the inner disc. The base, outer, and inner disc each include one ring which includes a plurality of ring segments having numbers thereon. The middle disc includes three concentric rings each of which is broken into ring segments having numbers thereon. The method of the present invention comprises selecting an initial base set of numbers at random, positioning the Velcro arrows adjacent those numbers on the inner disc, and recording the columns of numbers which appear on the middle disc located radially outwardly from each of the arrows positioned on the inner disc. The columns of numbers are recorded in a matrix, and the ultimate selection of numbers is accomplished by selecting the rows of numbers within the matrix.

9 Claims, 3 Drawing Figures

GAME CARD

32

| | | | | | | | |
|---|---|---|---|---|---|---|---|
| | | | 1 | 2 | 3 | 4 | |
| 5 | ~~6~~ | 7 | 8 | 9 | 10 | 11 | 12 |
| ~~13~~ | 14 | 15 | 16 | 17 | 18 | 19 | 20 |
| ~~21~~ | 22 | 23 | 24 | 25 | 26 | 27 | ~~28~~ |
| 29 | 30 | 31 | 32 | 33 | 34 | 35 | 36 |
| 37 | 38 | ~~39~~ | 40 | 41 | 42 | ~~43~~ | 44 |

56 BASE SET

| | | | | | |
|---|---|---|---|---|---|
| 6 | 13 | 21 | 28 | 39 | 43 |

FIRST MATRIX SET

58

| | | | | | |
|---|---|---|---|---|---|
| 39 | 32 | 24 | 17 | 6 | 2 |
| 6 | 13 | 21 | 28 | 39 | 43 |
| 40 | 25 | 30 | 11 | 10 | 38 |
| 5 | 20 | 15 | 34 | 35 | 7 |
| 27 | 42 | 37 | 12 | 13 | 29 |

SECOND MATRIX SET

60

| | | | | | |
|---|---|---|---|---|---|
| 40 | 33 | 25 | 18 | 7 | 3 |
| 5 | 12 | 20 | 27 | 38 | 42 |
| 20 | 15 | 14 | 41 | 5 | 16 |
| 25 | 30 | 31 | 4 | 40 | 29 |
| 3 | 8 | 9 | 26 | 18 | 7 |

METHOD AND MEANS FOR RANDOMLY SELECTING A PLURALITY OF GROUPS OF NUMBERS

BACKGROUND OF THE INVENTION

The present invention relates to a method and means for randomly selecting a plurality of groups of numbers.

One popular lottery game is the Lotto game. In one version of this game, the purchaser of the lottery ticket selects a combination of six numbers in the range of from 1 to 44. The selections are chosen so that no number is repeated in the combination. Other lottery games use more or less than six numbers, and use a range of numbers which may vary from the above range of 1 to 44.

One problem encountered in playing the above Lotto game occurs when the player wants to play more than one game. When playing several games, it is desirable to avoid repeating combinations of six numbers. It is also desirable to be able to select the numbers at random so that the combinations are randomly selected, even though a large number of games may be played.

Therefore, a primary object of the present invention is the provision of an improved method and means for randomly selecting a plurality of groups of numbers.

A further object of the present invention is the provision of a method and means for randomly selecting a plurality of groups of numbers without duplicating the groups of numbers.

A further object of the present invention is the provision of a method and means for randomly selecting a plurality of groups of numbers wherein the groups of numbers are randomly selected even though a large number of games may be played.

A further object of the present invention is the provision of a method and means for randomly selecting a plurality of groups of numbers which provides a systematic means for keeping track of the selected groups of numbers, so as to avoid duplication.

A further object of the present invention is the provision of a method and means for randomly selecting numbers which makes the selection of numbers entertaining and interesting to the player.

Another object of the present invention is the provision of a method and means which permits the groups of numbers to be selected in such a way that no one particular number is over-represented in the games that are formed.

A further object of the present invention is the provision of a device which permits the random selection of numbers with a minimum amount of time and effort.

A further object of the present invention is the provision of a method and means for selecting numbers which selects the numbers objectively with all numbers having an equal chance of selection.

A further object of the present invention is the provision of a method for randomly selecting numbers which is capable of using number bases other than the base 10.

A further object of the present invention is the provision of a method and means for randomly selecting numbers which may be used for purposes other than games such as scientific applications where statistically random or pseudo-random numbers are required.

A further object of the present invenion is to carry the original pattern formed by the base set of numbers selected from the pool of numbers throughout additional sets of numbers selected from the pool of numbers so as to form new patterns that differ from that of the base set.

SUMMARY OF THE INVENTION

The present invention utilizes a plurality of discs which are rotatably mounted with respect to one another about a common axis. The device includes a base disc, an outer disc which is slightly smaller than the base disc, a middle disc which is slightly smaller than the outer disc, and an inner disc which is smaller than the middle disc. All these discs are concentrically mounted with respect to one another and are adapted to rotate about a common axis.

The base disc includes an indicator mark on its outer edge, and this indicator mark is flanked on its opposite sides by two alternative indicator marks. The outer disc includes a plurality of ring segments extending around its outer circumference. Each of these segments is of equal circumferential length, and each of the segments includes numerical indicia marked thereon. Each segment includes three numbers thereon, a central number, an upper left hand number, and an upper right hand number.

The middle disc includes three middle disc rings marked thereon, and each ring includess a plurality of ring segments which are of equal length. The outer middle disc ring includes numerals marked thereon which are identical to the numerals marked on the outer disc ring. The ring segments of the remaining middle disc rings each include one numeral thereon.

The inner disc includes one ring having a plurality of segments of equal length thereon. Each inner disc ring segment includes one numeral thereon.

Also on the inner disc ring is a Velcro ring for receiving a plurality of Velcro arrows. The Velcro arrows may be detached and moved adjacent various numbers which appear on the inner disc ring.

In order to use the device for selecting groups of numbers, the base disc is rotated at random to six different positions. At each position the indicator mark is adjacent one segment of the outer disc ring. The middle numeral within that segment is recorded. This process is repeated six times until six different numbers have been recorded at random. In the event that any duplication occurs, alternate indicator marks are provided on the base disc and these alternate indicator marks may be used to select a non-duplicating number on the outer disc ring. This makes possible the selection of a group of six numbers wherein none of the six numbers are duplicated.

As each number of the original six numbers is selected, an arrow is attached to the Velcro ring on the inner disc adjacent that number on the inner disc ring. Thus, after the original six numbers have been selected, there are six arrows positioned adjacent each of those numbers on the inner disc ring.

Next, a set of five groups of numbers may be selected by recording the radial columns of numbers appearing on the middle disc radially outwardly from the arrows which have been positioned on the inner disc. Each of these columns of numbers is recorded in the columns of a matrix on a separate sheet of paper. After the matrix has been completed, the rows in the matrix are recorded, and the numbers in the rows are used as randomly selected groups of numbers for the lottery game. At this point, six groups of randomly selected numers have been chosen. The first group is the base group selected, and the remaining five groups are the five groups of numbers selected from the rows in the matrix.

A second matrix can be formed by indexing the middle disc in either a clockwise or a counterclockwise direction so that each column of middle disc segments is moved one position, either clockwise or counterclockwise, relative to the arrows which are positioned on the inner disc. After the indexing has been done, a new set of middle disc columns are positioned adjacent the arrows, and the numbers in these columns may be recorded to form a second matrix, thereby making possible the selection of five additional new sets of randomly selected numbers from the rows which appear in this second matrix.

This indexing process can be repeated 44 times, thereby producing 220 sets of randomly selected numbers.

If it is desired to select more than 220 sets of numbers, it is possible to do so by randomly selecting a second set of base numbers by rotating the base ring to six different numbers on the outer disc ring, as done in the original process. The arrows are then moved adjacent these newly selected base numbers, and the process is repeated. Thus, an additional 220 numbers may be selected.

New base numbers may be selected and new groups of 220 games may be selected as many times as the player wishes, thereby making possible the selection of literally millions of unique combinations of six numbers.

DETAILED DESCRIPTION OF THE EMBODIMENT

Figures 1, 2, 3:
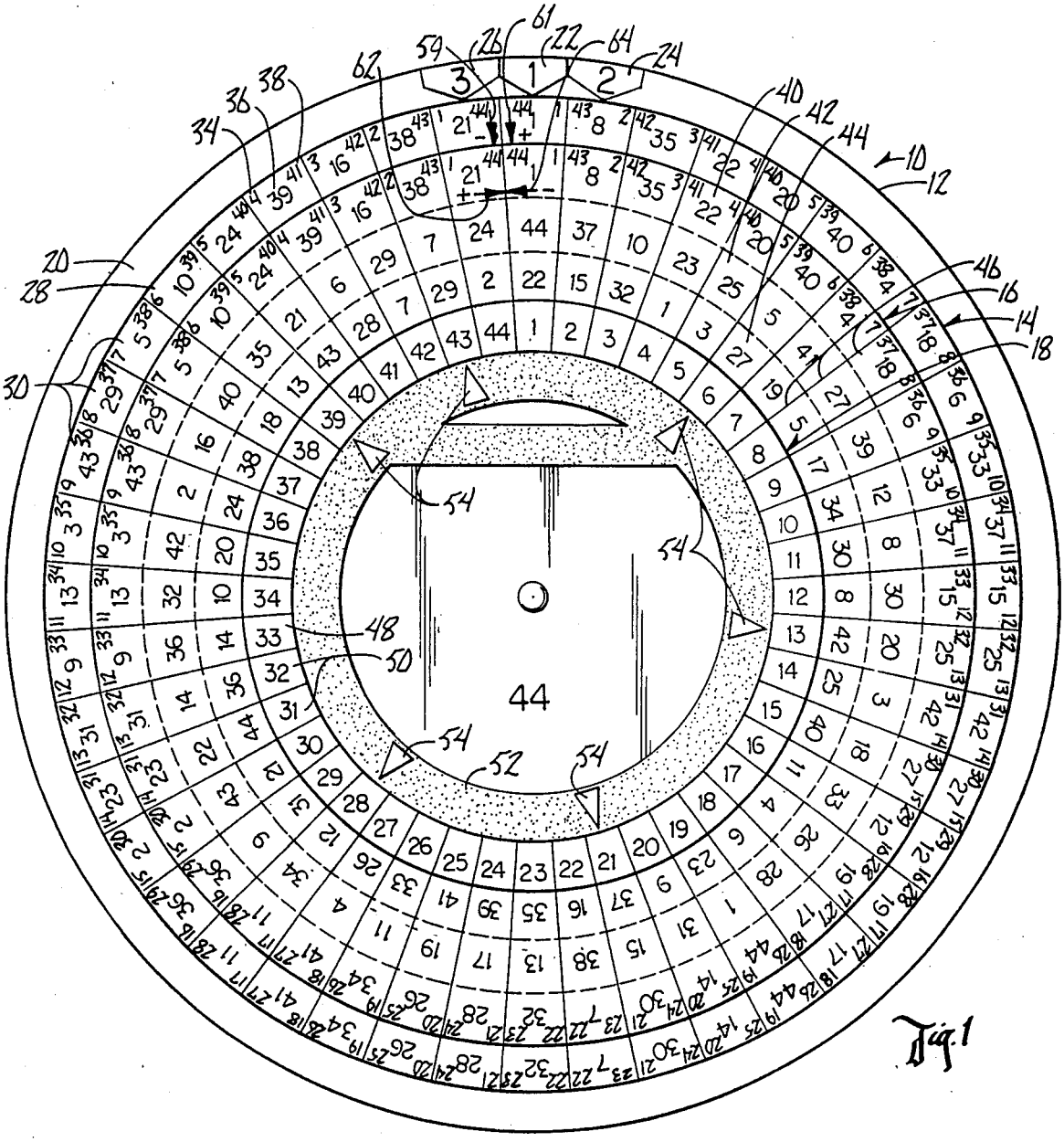
FIG. 1 is a plan view of the device of the present invention.
FIG. 2 is a view of a typical Lotto game card.
FIG. 3 is a view of the matrixs which may be formed by utilizing the device shown in FIG. 1.

The numeral 10 generally designates the random number selection device of the present invention. Device 10 includes a circular base disc 12, a circular outer disc 14, a circular middle disc 16, and a circular inner disc 18. Base disc 12 is the largest in diameter, and outer disc 14 is slightly smaller in diameter so as to leave a base disc ring 20 exposed radially outwardly beyond outer disc 14. Marked on base disc ring 20 is an indicator mark 22 having a pair of alternative indicator marks 24, 26 on opposite sides thereof.

Outer disc 14 is slightly larger than middle disc 16, so that an outer disc ring 28 is exposed beyond the outer edge of middle disc 16. Outer disc ring 28 is broken into a plurality of outer disc ring segments 30, each of which is equal in circumferential length. In the device shown in FIG. 1, there are 44 outer disc ring segments, but this number may be increased or decreased depending upon the range of numbers permitted by the particular Lotto game being played.

In FIG. 2, a typical Lotto game card 32 is shown, and includes the numbers 1 through 44. In playing this Lotto game, six numbers are chosen from the numbers shown on the card. It should be noted that by the nature of the game, it is not possible to duplicate any two numbers within the group of six which are chosen. Thus, each of the six numbers must be mutually independent from the others within the group of six.

Within each of the outer disc ring segments 30 are an upper left hand number 34, a middle number 36, and an upper right hand number 38. While the particular sequence of numbers from one segment to another may vary, the numbers shown in the drawing include a sequence wherein the upper left hand numbers progress from one through 44 in a counterclockwise direction, the upper right hand numbers progress from one through 44 in a clockwise direction, and the middle numbers are chosen at random.

The middle disc 16 is substantially larger than the inner disc 18, and includes three concentric middle disc rings 40, 42 and 44 exposed beyond the outer circumference of inner disc 18. Each middle disc ring 40, 42, 44 is broken into 44 equal ring segments 46. Within each ring segment 46 of the outermost middle disc ring 40 are three numbers. The numbers within the segments 46 of the outermost middle disc ring 40 are chosen to be identical to those numbers which appear in the outer disc ring 28. The numbers within ring segments 46 of middle disc rings 42, 44 are selected at random, and the patterns within each of the two middle disc rings 42, 44 are selected to be different from one another and also to be different from the pattern of numbers within the outermost middle disc ring 40.

The inner disc 18 includes an inner disc ring 48 having 44 inner disc ring segments 50 which are of equal size. The numerals 1 through 44 are positioned with one numeral in each of the ring segments 50, and are arranged in a clockwise direction around the inner disc ring 18.

Mounted on inner disc 18 is a circular Velcro piece 52 which is adapted to detachably receive six arrow indicators 54. While a Velcro piece 52 is used, other means of attachment such as pegs, magnets, or other securing means can be used without detracting from the invention.

The base disc 12, outer disc 14, middle disc 16, and inner disc 18 are rotatably mounted to one another for rotation about a common axis provided by a pivot pin 56. Each of the discs can be independently rotated with respect to the other discs.

The device is used to select random numbers in the following manner. Initially, a base set of numbers must be selected. This is done by rotating the base disc 12 at random to six different positions relative to the outer disc 14. In each of these six positions, indicator mark 22 is positioned adjacent an outer disc ring segment 30. The middle number 36 within that ring segment is recorded as one of the numbers of the base set. The recording of the base set is shown in FIG. 3 by the box designated by the numeral 56. As each number within the base set is selected, one of the arrow indicators 54 is detachably secured to the Velcro ring 52 adjacent the number selected as it appears on the inner disc ring 48. In the example shown in the drawings, the numerals 6, 13, 21, 28, 39 and 43 were selected for the base set. The arrows 54 are shown positioned adjacent each of these numbers on the inner disc ring.

In the event that a duplication of numbers occurs during the selection of the six base numbers, the alternate indicator selectors 24, 26 may be used for the selection of numbers. For example, if the first number selected by indicator 1 is the number 6, and if the second time a number is selected the indicator 22 is also positioned adjacent the number 6, it is possible to read the number of the outer disc ring which is adjacent alterate indicator 24 or the number which is positioned adjacent the alternate indicator number 26. This prevents a duplication of numbers within the base set and permits each of the numbers within the base set to be unique from one another. The use of arrows 54 also aids in preventing duplication of numbers by indicating each of the numbers selected from the base set.

After the base set of numbers has been selected, a first matrix set 58 (FIG. 3) may be recorded. The matrix set is recorded by forming the columns of the matrix set from the numbers which appear in the middle disc rings positioned radially outwardly from the arrows 54. As can be seen in FIG. 1, the ring segments within the inner disc ring, the middle disc rings, and the outer disc ring form a radial column which has a radial column of numbers thereon. The numbers selected for each column in the matrix set are chosen from the column of middle disc segments positioned radially outwardly from the arrows 54.

In the examples shown in the drawings, the first column of the matrix set is chosen by the numbers in the middle disc rings which are positioned radially outwardly from the number 6 of the inner disc ring. The numbers are recorded, progressing from the outermost middle disc ring to the innermost middle disc ring. The numbers within the outermost middle disc ring are chosen using the upper left hand number, the upper right hand number, and the middle number, in that order.

As can be seen from the drawings, each of the columns in the first matrix set correspond to the middle disc members which are positioned radially outwardly from each of the arrows 54. After the first matrix set has been formed, the random groups of numbers for the game are chosen by selecting the rows of numbers within the first matrix set. Each row of numbers represents a group of numbers which can be used for a game. For example, the first row from matrix set 58 shows a group of randomly selected numbers which include 39, 32, 24, 17, 6 and 2. Thus, by the completion of the first matrix set, the player has selected six groups of numbers for six different games, the first group being the base set of numbers, and the remaining five groups being the rows of numbers which appear in the first matrix set.

A second matrix set may be formed by indexing the middle disc one position to the right relative to both the inner disc and the outer and base discs. If preferred, indexing can be done to the left instead of to the right, but for purposes of the example in the drawing, the indexing is assumed to be to the right. This will result in the arrows 54 being positioned between new columns of numbers within the middle disc rings. These new columns of numbers may be recorded to form the second matrix 60 set as shown in FIG. 3. The rows of this second matrix set 58 produce numbers for playing five additional games.

Additional matrix sets may be formed by indexing the middle disc one position to the right for each new matrix set and by recording the numbers in the radial columns positioned radially outwardly from each of the arrows 54. This process may be repeated 44 times before a complete revolution of the middle disc is completed. This will produce a total of 221 games, 220 games being provided by the 44 matrix sets, and the additional game being provided by the first base set.

If it is desired to play more than 221 games, it is possible to repeat the procedure again by merely selecting a new base set of numbers and then recording 44 new matrix sets based upon the position of the arrows 54 relative to the newly chosen base set of numbers. This process can be repeated until the desired number of games has been played.

Duplication of numbers will not occur within any group of numbers derived from a single base set of numbers. That is, in any group of 221 games, there will not be duplication. However, it is possible in certain circumstances that duplication might occur on occasion between groups of 220 games. However, these duplications are believed to be minimal, and they can be detected by analyzing and inspecting the numbers selected.

Provided on outer disc ring 28 are a pair of advancing increment indicator arrows 59, 61, and similar arrows 62, 64 are provided on the outermost middle disc ring 40. These arrows help the player keep track of the number of times that the middle disc ring has been indexed. For example, the middle disc ring is shown in its initial position in FIG. 1. However, if the middle disc is indexed one position to the right, the arrow 61 will be positioned adjacent the outermost middle disc ring segment having the numerals 1, 21 and 44 therein. The upper left hand number 1 in that ring segment indicates that one indexing has taken place. A second indexing will result in the upper left hand number 2 being positioned adjacent arrow 61 and so on.

If the middle disc ring is indexed in a counterclockwise direction, then the upper right hand number within the outermost middle disc ring segment will indicate how many indexings have taken place. This enables the operator to keep track of the number of times that indexing has taken place.

While the device of the present invention is shown for selecting a group of six numbers and for selecting those numbers from a range of the numbers 1 through 44, these parameters may be varied without detracting from the invention. A larger or smaller group of numbers may be chosen other than the range of from 1 to 44. Similarly, the number of base numbers originally selected may vary to be either more or less than the number 6.

The device is simple to operate and provides the player with a means for randomly selecting numbers easily and quickly.

Thus, it can be seen that the device accomplishes at least all of its stated objectives.

What is claimed is:

1. A device for randomly selecting a plurality of groups of numbers comprising:

a circular outer disc having a circumferential outer disc ring marked into a predetermined number n of equally sized outer disc ring segments;

a circular middle disc having a diameter less than said outer disc and being arranged concentrically with respect to said outer disc so as to leave said outer disc ring exposed radially beyond said middle disc, said middle disc having a plurality of concentrically arranged middle disc rings marked thereon, each of said middle disc rings being marked and subdivided into said predetermined number n of equally sized middle disc ring segments, said middle disc ring segments also being arranged in said predetermined number n of radially extending middle disc columns progressing from the innermost radial one of said middle disc rings to the outermost radial one of said middle disc rings;

a circular inner disc having a diameter less than said middle disc and being arranged concentrically with respect to said middle disc so as to expose said plurality of middle disc rings to view radially outwardly from said inner disc;

said inner disc having a circumferential inner disc ring marked into said predetermined number n of equally sized inner disc ring segments;

means rotatably mounting said outer, middle and inner discs to one another for rotation about a common axis coincident with the circular centers thereof;

each of said outer disc ring segments, said middle disc ring segments, and said inner disc ring segments having numerical indicia marked thereon, said numerical indicia corresponding to numbers selected from 1 to n;

a plurality of marker members;

securing means on said inner disc for detachably securing each of said marker members adjacent randomly selected ones of said inner disc ring segments.

2. A device according to claim 1 wherein each of said ring segments of at least one of said middle disc rings includes a first numerical indicia representing a number from 1 to n, a second numerical indicia representing a number from 1 to n, and a third numerical indicia representing a number from 1 to n.

3. A device according to claim 2 wherein said first, second and third numerical indicia are arranged in first, second and third numerical sequences respectively progressing circumferentially around said segments of said one middle disc ring, said first, second and third numerical sequences being different from one another.

4. A device according to claim 4 wherein said ring segments of the remaining ones of said middle disc rings other than said one disc ring each include a single numerical indicia thereon, sequences of said numerical indicia around the circumference of each of said remaining middle disc rings being different from one another and being different from said first, second, and third sequences of said one middle disc ring.

5. A device according to claim 1 wherein a base disc having a diameter greater than said outer disc is rotatably mounted beneath said outer disc for rotation about said common axis, said base disc having a base disc ring positioned radially outwardly from said outer disc ring, a marker indicia being on said base disc ring and being selectively movable with said disc ring to a plurality of random positions adjacent various ones of said ring segments on said outer disc ring.

6. A method for randomly selecting a plurality of groups of numbers using a random number selection device comprising a circular outer disc having a circumferential outer disc ring marked into a predetermined number n of equally sized outer disc ring segments; a circular middle disc having a diameter less than said outer disc and being arranged concentrically with respect to said outer disc so as to leave said outer disc ring exposed radially beyond said middle disc, said middle disc having a plurality of concentrically arranged middle disc rings marked theron, each of said middle disc rings being marked and subdivided into said predetermined number n of equally sized middle disc ring segments, said middle disc ring segments also being arranged in said predetermined number n of radially extending middle disc columns progressing from the innermost radial one of said middle disc rings to the outermost radial one of said middle disc rings; a circular inner disc having a diameter less than said middle disc and being arranged concentrically with respect to said middle disc so as to expose said plurality of middle disc rings to view radially outwardly from said inner disc; said inner disc having a circumferential inner disc ring marked into said predetermined number n of equally sized inner disc ring segments; means rotatably mounting said outer, middle, and inner discs to one another for rotation about a common axis coincident with the circular centers thereof; each of said outer disc ring segments, said middle disc ring segments, and said inner disc ring segments having numerical indicia marked thereon, said numerical indicia corresponding to numbers selected from 1 to n; a plurality of marker members; securing means on said inner disc for detachably securing each of said marker members adjacent randomly selected ones of said inner disc ring segments, said method comprising:

randomly selecting a first random group of numbers;

detachably securing said marker members adjacent a first group of said inner disc ring segments having numerical indicia thereon corresponding to said first group of numbers;

moving said middle disc to a first position wherein a first group of said middle disc columns is in registered alignment radially outwardly from said first group of said inner disc ring segments;

recording a first matrix of numbers comprising a plurality of matrix columns of numbers and a plurality of matrix rows of numbers, said matrix column each containing numbers corresponding to said numerical indicia within a different one of said middle disc columns of said first group of said middle disc columns; and selecting additional random groups of numbers corresponding to the numbers within each of said matrix rows.

7. A method according to claim 6 comprising rotating said middle disc to a second position wherein a second group of middle disc columns is registered radially outwardly from said first group of said inner disc ring segments; recording a second matrix from said numerical indicia on said second group of middle disc columns and selecting additional random groups of numbers from said matrix rows of said second matrix in the same fashion as said selection of random groups of numbers from said matrix rows of said first matrix.

8. A method according to claim 6 comprising rotating said middle disc a total of n times to a plurality of n unique positions; repeating said recording on nth matrix each time said middle disc is rotated, and also each time selecting additional random groups of numbers from said matrix rows of said nth matrix whereby all of said random groups of numbers so selected are unique from one another.

9. A device for randomly selecting a plurality of groups of numbers comprising:

a circular first disc having a predetermined number n of groups of numerical indicia positioned in equally spaced circumferential positions around the circumference of said first disc, said numerical indicia within each of said groups representing a predetermined sequence of numbers; said predetermined sequence of numbers within each one of said groups being unique with respect to said predetermined sequences of numbers within the other of said groups;

a circular inner disc having a diameter less than said first disc and being arranged concentrically with respect to said first disc so as to expose said groups of numerical indicia of said first disc to view radially outwardly from said inner disc;

said inner disc being marked into said predetermined number n of inner disc positions located equidistant from one another around the circumference of said inner disc;

a plurality of marker numbers;

securing means on said inner disc for detachably securing each of said marker members adjacent randomly selected ones of said inner disc ring positions;

means rotatably mounting said first and inner discs to one another for rotation about a common axis coincident with the circular centers thereof;

said first disc being rotatable about said common axis to a plurality of positions wherein all of said groups of numerical indicia on said first disc are in registered alignment in outward radial spaced relation to all of said inner disc positions of said inner disc.

* * * * *